US007199318B2

(12) United States Patent
Buxton et al.

(10) Patent No.: US 7,199,318 B2
(45) Date of Patent: Apr. 3, 2007

(54) AIR GUIDANCE DEVICE FOR COOLING A SWITCH PART OF AN ELECTRICAL SWITCH

(75) Inventors: Clifford A. Buxton, Berlin (DE); Stefan Losch, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 237 days.

(21) Appl. No.: 10/860,271

(22) Filed: Jun. 4, 2004

(65) Prior Publication Data

US 2005/0006350 A1 Jan. 13, 2005

(30) Foreign Application Priority Data

Jun. 4, 2003 (DE) ..... 103 26 355

(51) Int. Cl.
*H01H 13/04* (2006.01)

(52) U.S. Cl. ..... 200/306; 200/400; 335/201; 218/151

(58) Field of Classification Search ..... 218/151–157, 218/35, 39, 46–47; 335/201–202; 200/306, 200/400

See application file for complete search history.

(56) References Cited

U.S. PATENT DOCUMENTS 3,359,724 A * 12/1967 Downing et al. ..... 60/266
4,639,564 A * 1/1987 Grunert et al. ..... 218/156
4,777,806 A * 10/1988 Perez ..... 62/256
5,569,894 A * 10/1996 Uchida et al. ..... 218/27
6,037,555 A * 3/2000 Castonguay et al. ..... 218/157
6,479,781 B1 * 11/2002 Bagepalli et al. ..... 218/156
6,624,375 B2 * 9/2003 Leone et al. ..... 218/155
6,838,962 B2 * 1/2005 Leone et al. ..... 335/202
6,924,721 B2 * 8/2005 Afshari et al. ..... 335/202

FOREIGN PATENT DOCUMENTS

DE 38 39 269 A1 5/1990

* cited by examiner

*Primary Examiner*—K. Lee
(74) *Attorney, Agent, or Firm*—Harness, Dickey & Pierce, P.L.C.

(57) ABSTRACT

An air guidance device is for cooling a switch part of an electrical switch. It includes at least one air guidance element arranged at a distance from the switch part to be cooled, forming at least one air duct which runs vertically when the switch is in the installed position. The air duct includes an inlet area, which points downwards, for cooling air to flow therein, and having an outlet area, which points upwards, for cooling air to flow out thereof. In order to improve the heat dissipation, the air guidance element is shaped such that the inlet area tapers in the direction of the outlet area.

18 Claims, 1 Drawing Sheet

AIR GUIDANCE DEVICE FOR COOLING A SWITCH PART OF AN ELECTRICAL SWITCH

The present application hereby claims priority under 35 U.S.C. §119 on German patent application number DE 103 26 355.1 filed Jun. 4, 2003, the entire contents of which are hereby incorporated herein by reference.

FIELD OF THE INVENTION

The invention generally relates to the field of electrical switches, and is generally applicable to the design configuration of an air guidance device for cooling a switch part.

BACKGROUND OF THE INVENTION

In a known electrical switch in the form of a low-voltage circuit breaker, an air guidance device is provided in order to cool pole path chambers. This air guidance device has panels which are provided with depressions on each of their two surfaces. Each of the depressions in this case forms an air guidance element, which is arranged at a distance from the switch part to be cooled, forming an air duct which runs vertically when the switch is in the installed position. The air duct includes an inlet area, which points downwards, for cooling air to flow into, and includes an outlet area, which points upwards, for cooling air to flow out of (DE 38 39 269 A1).

SUMMARY OF THE INVENTION

An embodiment of the invention includes an object of improving the heat dissipation.

According to an embodiment of the invention, an object may be achieved by an air guidance element shaped such that the inlet area tapers in the direction of the outlet area. A refinement such as this of the inlet area of the air duct, which is thus aerodynamically equivalent to a nozzle, leads to an increase in the flow velocity in the air duct. It thus leads to improved transfer of the heat from the switch part to be cooled to the cooling air, and thus leads to faster dissipation of the heated cooling air.

One advantageous refinement of an embodiment of the invention provides for the outlet area to widen in the flow direction. This refinement of the outlet area of the air duct is aerodynamically equivalent to a diffuser. This thus results in the minimum air drag in the air guidance device.

Two or more air guidance elements which run essentially aligned can advantageously be provided in order to form an air duct which is associated with two or more switch parts that are arranged one above the other. This allows the air guidance device to be optimally matched to the physical space available in the electrical switch.

As in the case of the known air guidance device, it is advantageous to provide two or more air guidance elements, which are arranged essentially in mirror-image symmetrical form, in order to form two or more air ducts, which are associated with switch parts that are arranged alongside one another.

One preferred refinement of an embodiment of the novel air guidance device provides that the air guidance element or elements is or are in the form of a flexible panel or panels and is or are held by a common mount. Panels such as this can be manufactured, for example, at particularly low cost from plastic. They can then additionally act as electrical insulators. The mount may be provided with at least one groove in order to hold at least one respective edge section of the panels.

The panels can be fixed in a simple manner on the mount by way of attachment elements which pass through the side surfaces of the groove and through the edge sections of the panels which are held in the groove.

The novel air guidance device can be used in a preferred manner for cooling of isolating contact systems in an electrical switch—in this case, it is advantageous for the mount for the at least one air guidance device to be positioned by means of a tongue and groove connection on a rear wall of the switch.

BRIEF DESCRIPTION OF THE DRAWINGS

The present invention will become more fully understood from the detailed description of preferred exemplary embodiments given hereinbelow and the accompanying drawing, which is given by way of illustration only and thus are not limitative of the present invention, and wherein.

DETAILED DESCRIPTION OF THE PREFERRED EMBODIMENTS

Figure 1:
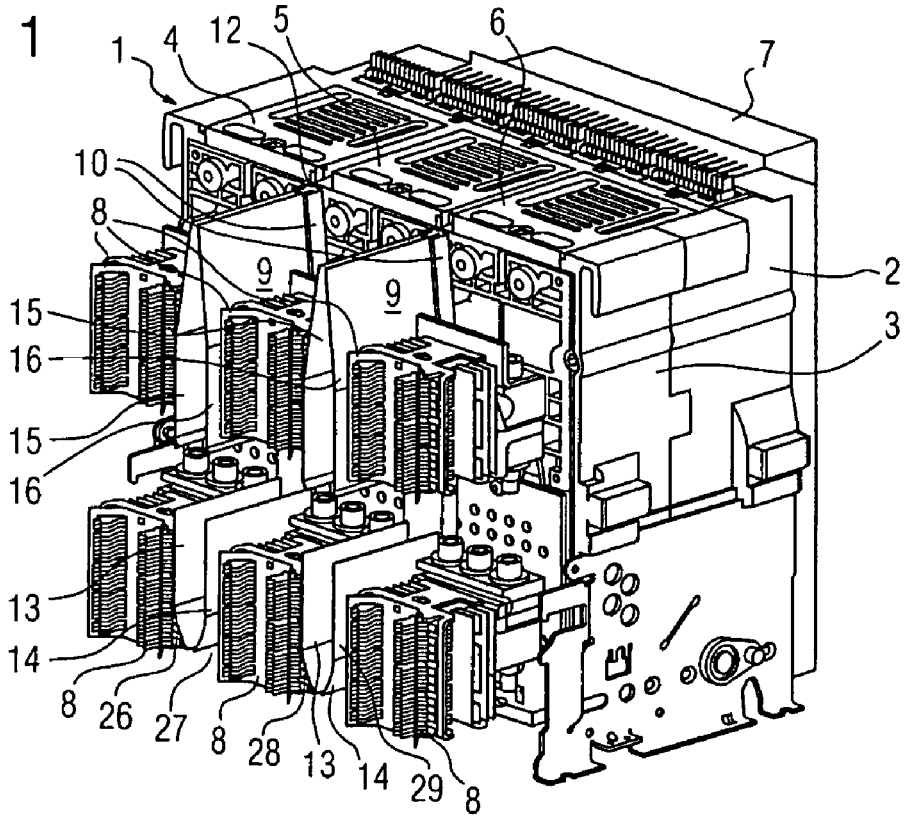
FIG. 1 shows a three-pole low-voltage circuit breaker having isolating contact systems which are mounted on a rear wall of the switch and are associated in pairs with the poles, and having two air guidance devices which are arranged between the isolating contact systems.

As is shown in FIG. 1, the low-voltage circuit breaker 1 has a switch pole housing, which includes a front wall 2 and a rear wall 3, for holding the switch poles 4, 5 and 6. For the purposes of an embodiment of the invention, the expression "a switch pole" should in this case be understood as meaning all parts of the circuit breaker which are associated with the main circuit and are equipped with switching pieces for closing and opening. This excludes those parts of the circuit breaker which are used for joint attachment and operation of all of the poles and which are held essentially under a covering shroud 7 of the circuit breaker 1 by way of a supporting mechanism on the front wall 2 of the switch pole housing. Isolating contact systems 8 which are associated in pairs with the switch poles 4, 5 and 6 and are in the form of lower and upper laminate blocks are arranged on the rear wall 3 of the switch pole housing and, during insertion of the circuit breaker into a withdrawable rack in a switch gear cabinet (which is not illustrated) or a switch gear assembly, engage over vertically running connecting rails.

Since the airflow in switch gear assemblies and switch gear cabinets runs upwards from the bottom, an air guidance device 9 for cooling the isolating contact systems 8 is arranged in each case between the isolating contact systems 8 of adjacent switch poles 4 and 5 as well as 5 and 6. These air guidance devices 9 each have a mount 10, which is positioned via a tongue and groove connection on the rear wall 3 of the circuit breaker 1 and is attached to the rear wall 3 via first attachment device 43. This mount 10 is in the form of a panel and, on its side facing the rear wall 3, has a tongue 11 in the form of an edge-like projection, which engages in an associated groove 12 in the rear wall 3. In this case, the two mounts 10 (which, since they are flat, occupy very little physical space) extend essentially over the entire height of the rear wall 3 of the circuit breaker. A first air guidance element 13 and a second air guidance element 14 are held on the mount 10, in each case in that area of the mount 10 which points downwards, and thus between the lower laminate blocks. Furthermore, a third air guidance element 15 and a fourth air guidance element 16 are held on the mount 10, in each case in that area of the mount 10 which points upwards, and thus between the upper laminate blocks.

Figure 2:
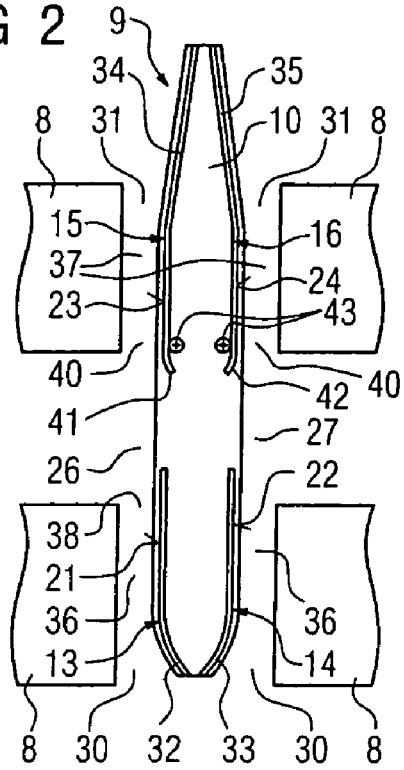
FIG. 2 shows a first view of the air guidance devices illustrated in FIG. 1, looking at the rear wall of the switch.
Figure 3:
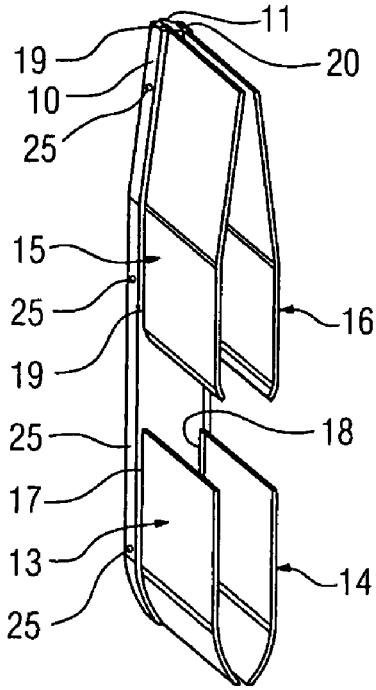
FIG. 3 shows a perspective view of the air guidance device shown in FIG. 2.

As is shown in FIGS. 2 and 3, the four air guidance elements 13, 14, 15 and 16 are in the form of thin, curved panels, preferably composed of plastic, and thus cost very little. Panels formed from plastic additionally have the advantage that they are at the same time used as electrical insulators between the isolating contact systems 8 of the adjacent switch poles 4 and 5 as well as 5 and 6. An edge section 17, 18, 19 and 20 on each of the panels engages in an associated groove 21, 22, 23 and 24, respectively, in the mount 10, on its side facing away from the rear wall 3 of the circuit breaker. Two second attachment devices 25 are in each case used to securely fix each of the air guidance elements 13, 14, 15 and 16, respectively, on the mount 10, and pass through the side surfaces of the groove and through the edge sections 17, 18, 19 and 20, respectively, of the panels which are held in the groove, transversely with respect to the panels.

The profile of the grooves 21, 22, 23 and 24 is designed such that the inserted, curved panels form air ducts 26, 27, 28 and 29 in order to cool the isolating contact systems 8, which air ducts 26, 27, 28 and 29 run vertically when the circuit breaker is in the installed position and have an inlet area 30, which is open at the bottom, as well as an outlet area 31, which is open at the top. In this case, the isolating contact systems 8 of the first, outer switch pole, which is shown on the left in FIG. 1, have a first associated air duct 26, the isolating contact systems of the central switch pole have a second associated air duct 27 and a third associated air duct 28, and the isolating contact systems of the second, outer switch pole, which is illustrated on the right in FIG. 1, have a fourth associated air duct 29.

Each of the four air ducts is thus in each case used to cool two isolating contact systems 8 which are arranged one above the other. To do this, two of the air guidance elements each run essentially aligned. The first air duct 26 and the third air duct 28 are thus respectively formed by the first air guidance element 13 and the third air guidance element 15 of one of the two air guidance devices 9, and the second air duct 27 and the fourth air duct 29 are respectively formed by the second air guidance element 14 and the fourth air guidance element 16 of one of the two air guidance devices 9. Since the lower and upper laminate blocks of the respectively adjacent switch poles are arranged alongside one another when the circuit breaker is in the installed position, the respective first 13, second 14, third 15 and fourth 16 air guidance elements, which are each held on a common mount 10, are arranged essentially in mirror-image symmetrical form.

By appropriately selected first sections 32 and 33 (which run in a curve) of the lower grooves, and angled second sections 34 and 35, respectively, of the upper grooves, the air guidance elements are shaped such that each of the inlet areas tapers in the direction of the outlet area, and such that each of the outlet areas widens in the flow direction. Since the air guidance elements 13 and 14 which are associated with the lower laminate blocks and the air guidance elements 15 and 16 which are associated with the upper laminate blocks are at a distance from one another, each of the air ducts 26, 27, 28 and 29 is subdivided into a lower duct section 36 and an upper duct section 37.

In order to concentrate the cooling air emerging from the outlet area 38 of the lower duct section 36 when it enters the inlet area 40 of the upper duct section 37, and to accelerate it, the inlet area 40 of the upper duct section 37 is tapered in the flow direction. For this purpose, the groove 23 which holds the third air guidance element 15 and the groove 24 which holds the fourth air guidance element 16 have a third respective section 41 and 42, which runs in a corresponding manner in a curve, in order to shape the third and fourth air guidance elements appropriately during insertion into the groove.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An air guidance device for cooling at least one switch part of an electrical switch, comprising:

at least one air guidance element arranged at a distance from the at least one switch part to be cooled, the at least one air guidance element forming at least one air duct running vertically when the electrical switch is in the installed position, the at least one air duct including, an inlet area, pointing downwards, for cooling air flowing into the at least one air duct, and an outlet area, pointing upwards, for cooling air flowing out of the at least one air duct, wherein the at least one air guidance element is shaped such that the inlet area tapers in the direction of the outlet area wherein the at least one air guidance element is in the form of a flexible panel and is held by a common mount.

2. The air guidance device as claimed in claim 1, wherein the outlet area widens in the flow direction.

3. The air guidance device as claimed in claim 2, wherein at least two air guidance elements are included, essentially aligned with one another, to form one air duct associated with at least two switch parts arranged one above the other.

4. The air guidance device as claimed in claim 2, wherein at least two air guidance elements are provided and are arranged essentially in mirror-image symmetrical form in order to form at least two air ducts associated with switch parts that are arranged alongside one another.

5. The air guidance device as claimed in claim 1, wherein at least two air guidance elements are included, essentially aligned with one another, to form one air duct associated with at least two switch parts arranged one above the other.

6. The air guidance device as claimed in claim 1, wherein at least two air guidance elements are provided and are arranged essentially in mirror-image symmetrical form in order to form at least two air ducts associated with switch parts that are arranged alongside one another.

7. The air guidance device as claimed in claim 1, wherein the mount is provided with at least one groove in order to hold at least one respective edge section of the panel.

8. The air guidance device as claimed in claim 7, further comprising:

attachment elements, provided in order to fix the panels on the mount, with each passing through side surfaces of the groove and through that edge section of the panel held in the groove.

9. An electrical switch having isolating contact systems, comprising:

at least one air guidance device as claimed in claim 1, in order to cool the isolating contact systems.

10. The electrical switch as claimed in claim 9, wherein the mount for the at least one air guidance device is positioned via a tongue and groove connection on a rear wall of the switch.

11. An electrical switch, comprising:

at least one isolating contact system; and at least one air guidance element to cool the at least one isolating contact system, the at least one air guidance element forming at least one air duct including, an inlet area for cooling air flowing into the at least one air duct, and an outlet area for cooling air flowing out of the at least one air duct, wherein the at least one air guidance element is shaped such that the inlet area tapers in the direction of the outlet area, wherein the at least one air guidance element is in the form of a flexible panel and is held by a common mount.

12. The electrical switch as claimed in claim 11, wherein the mount for the at least one air guidance device is positioned via a tongue and groove connection on a rear wall of the switch.

13. A device for cooling at least one part of an electrical switch, comprising:

at least one air guidance element, arranged to cool the at least one part of the electric switch, including, an inlet area for cooling air flowing into the at least one air guidance element, and an outlet area for cooling air flowing out of the at least one air guidance element, wherein the at least one air guidance element is shaped such that the inlet area tapers in the direction of the outlet area, wherein the at least one air guidance element is in the form of a flexible panel and is held by a common mount.

14. The device as claimed in claim 13, wherein the outlet area widens in the flow direction.

15. The device as claimed in claim 13, wherein at least two air guidance elements are included, essentially aligned with one another, to form one air duct associated with at least two parts of the electrical switch arranged one above the other.

16. The air guidance device as claimed in claim 13, wherein at least two air guidance elements are provided and are arranged essentially in mirror-image symmetrical form in order to form at least two air ducts associated with parts of the electrical switch that are arranged alongside one another.

17. The air guidance device as claimed in claim 13, wherein the mount is provided with at least one groove in order to hold at least one respective edge section of the panel.

18. The air guidance device as claimed in claim 17, further comprising:

attachment elements, provided in order to fix the panels on the mount, with each passing through side surfaces of the groove and through that edge section of the panel held in the groove.

* * * * *